United States Patent [19]

Bosman

[11] 4,204,649

[45] May 27, 1980

[54] SPOOLING MACHINE

[76] Inventor: Aleidus G. Bosman, 17, Van Bergenlaan, Wassenaar, Netherlands

[21] Appl. No.: 933,505

[22] Filed: Aug. 14, 1978

[30] Foreign Application Priority Data

Aug. 19, 1977 [BE] Belgium ..... 180307

[51] Int. Cl.[2] ..... B65H 54/30; B65H 54/48

[52] U.S. Cl. ..... 242/43 R; 242/18 DD

[58] Field of Search ..... 242/43 R, 43.2, 18 R, 242/18 DD

[56] References Cited

U.S. PATENT DOCUMENTS

| | | | |
|---|---|---|---|
| 459,039 | 9/1891 | Foster | 242/43 R |
| 1,135,090 | 4/1915 | Allen | 242/43 R |
| 1,490,715 | 4/1924 | Schweiter | 242/43 R |
| 2,664,249 | 12/1953 | Wright | 242/43 R |
| 2,998,203 | 8/1961 | Pitts | 242/42.2 |
| 3,861,607 | 1/1975 | Schippers et al. | 242/43 R |

FOREIGN PATENT DOCUMENTS

| | | | |
|---|---|---|---|
| 552207 | 3/1943 | United Kingdom | 242/43 R |

*Primary Examiner*—Stanley N. Gilreath

*Attorney, Agent, or Firm*—Cushman, Darby & Cushman

[57] ABSTRACT

There is described a spooling machine comprising a displacement device to reciprocate the material to be spooled during the spooling thereof, along the lengthwise axis of the bearing axis, said displacement device comprising a pattern roller mounted relative to the frame which is provided with a first endless groove that runs alternately as a screw-thread over the pattern roller, means to drive the pattern roller, a guide member for the thread-like material which enters with a portion thereof in the pattern roller and a guideway over which the guide member is reciprocable along the pattern roller, with the pattern roller also including a second groove, for guiding the thread-like material, at least next to the point of inflection of the first groove.

5 Claims, 5 Drawing Figures

SPOOLING MACHINE

The invention pertains to a spooling machine for thread-like material, particularly yarns, which comprises a frame, a bearing axis mounted thereon for the core on which the material has to be spooled, a driving roller mounted on said frame for driving the material-bearing core, means to drive the driving roller, means to engage the material with the driving axis to cause driving of the material-bearing core, and a displacement device to reciprocate the material to be spooled during the spooling thereof, along the lengthwise axis of the bearing axis, said displacement device comprising a pattern roller mounted relative to the frame which is provided with an endless groove that runs alternately as a screw-thread over said roller, means to drive the pattern roller, a guide member for the thread-like material which enters with a portion thereof in the pattern roller and a guideway over which the guide member is reciprocable along the pattern roller.

In known spooling machines of the above-defined kind, the pattern roller and the driving roller are comprised of different rollers which are spaced from one another. Even when the means to drive both said rollers could be partly common, said known spooling machines are relatively costly due to the requirement of having two rollers which are to be supported relative to the frame. Moreover it is usual to mount the pattern roller inside an oil bath which further increases the costs. The pattern roller and consequently also the guide member lie relatively far away from the core on which the thread-like material is to be spooled which makes it difficult to obtain a good spool at high speed on such machines.

Spooling machines are also known whereby the driving roller is itself provided with an endless groove running alternately as a screw-thread. The thread-like material is guided inside the groove proper, which has a special elaborate profile. Said known machines thus do not comprise a displacement device with a pattern roller, a guide member for the material and a guideway for the guide member and consequently they are not of the kind the invention is concerned with. Said machines have the drawback that the friction of the thread-like material inside the groove of the driving roller, which groove has to be relatively deep locally, is strong and there is thus a danger of damaging said thread-like material. Said known spooling machines are actually relatively cheap but the quality of spooling leaves something to be desired.

The invention has for object to obviate all of these drawbacks and to provide a spooling machine the displacement device of which still comprises a pattern roller, a guide member for the thread-like material and a guide way for the guide member, but which is of simple construction and relatively cheap while still allowing a very good spooling at relatively high speed and without any danger of damaging the thread-like material while doing away with the requirement that to obtain a good spool at high speed, the guide member should lie close to the spool body.

For this purpose, the pattern roller of the displacement device is comprised of the driving roller proper and the means to drive the pattern roller are simultaneously those means to drive the driving roller.

It is clear that the pattern roller which forms simultaneously the driving roller cannot be mounted inside an oil bath. This is not required with a suitable selection of the pattern roller and with a suitable design of the groove provided in said roller and of that guide member portion entering said groove.

In a particular embodiment of the invention, the pattern roller that forms simultaneously the driving roller, is made from synthetic material.

In this embodiment the friction of the guide member inside the groove is minimized in such a way that it is clear that no lubricating of the pattern roller groove will be required.

In a preferred embodiment of the invention, the pattern roller that forms simultaneously the driving roller, is provided besides the groove for the guide member, with an additional groove for the thread-like material, said groove lying at least next to the points of inflection of said groove running alternately as a screw-thread, that is thus where the groove changes direction.

Other details and features of the invention will stand out from the description given below by way of non limitative example and with reference to the accompanying drawings, in which.

In the various figures, the same reference numerals pertain to similar elements.

Figure 1:
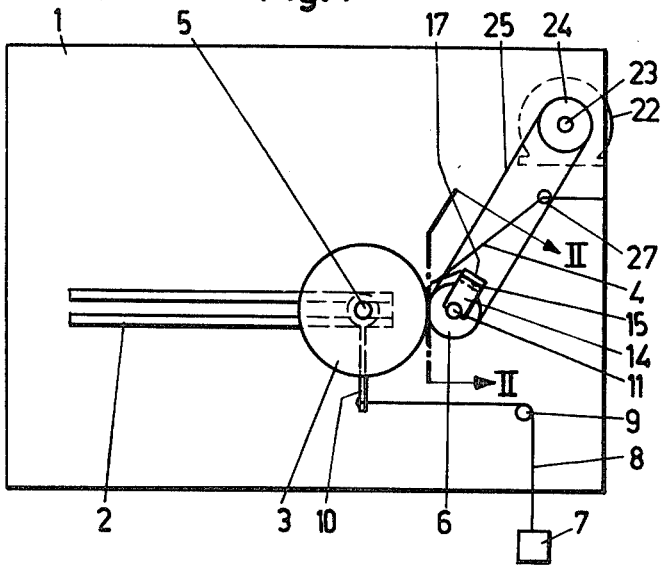
FIG. 1 is a front view of a spooling machine according to the invention.

The spooling machine as shown in the drawings comprises a frame which is mainly formed by an upstanding wall 1. To this wall is made fast a horizontally-running profile fillet 2 which forms a guideway for a core 3 over which yarn 4 is to be spooled. Said core 3 is supported about an axis 5 which lies approximately at right angle to the wall 1 and thus also to the profile fillet 2. Said core 3 has a larger-diameter end which is slidably mounted in said profile fillet 2.

On wall 1 is also mounted a driving roller 6. The core 3 together with yarn windings which are possibly wound about the core, is continually pressed with a constant force against the driving roller 4 by means of a weight 7. Said weight 7 hangs from a cable 8 which runs about a small wheel 9 which is rotably mounted on wall 1 and lies relative to core 3 on the same side as driving roller 6. Said cable 8 is fastened with the end thereof to a rod 10 which is fast to the axis 5. Due to the weight 7, the axis 5 tries continually to move inside the profile fillet 2 towards the small wheel 9.

The driving roller 6 is rotatable by means of ball bearings not shown in the figures, about a fixed axis 11 which passes with an end thereof through an opening 12 in wall 1. That end of axis 11 lying on the back side of wall 1 is provided with a screw thread and a nut 13 is screwed thereon. The axis 11 is pulled thereby through the opening 12 but said axis 11 is retained on the side of driving roller 6 due to a metal yoke 14, 15 being mounted thereon. Both legs 14 of said yoke are clamped with the ends thereof respectively on either side of driving roller 6 on axis 11. That leg 14 lying on the side of wall 1 is moreover clamped against wall 1 by the tightening of nut 13. That yoke part 15 lying between both legs 14 runs in parallel relationship with the driving roller 6 and slants above said roller 6 on that side away from core 3. Yoke part 15 is provided with a groove 16 running over the whole length thereof, that is in parallel relationship with the rotation axis of driving roller 6.

That yoke part 15 lying between both legs 14 forms a guideway for a guide member 17. Said guide member 17 comprises a body 18 from synthetic material which goes through groove 16 and which is provided both above and below part 15 with an overthickness in such a way that said body is alternately slidable but over the whole length of groove 16 on yoke part 15 without being removable therefrom. The guide member 17 further comprises a thread guide 19 which is mounted on body 18. Said thread guide 19 projects from part 15 and is bent downwards with the end thereof in such a way as to reach below said part 15. Said latter end lies on the side of core 3 relative to part 15. The yarn 4 to be spooled is automatically led in this end by the thread guide. The guide member 17 finally also comprises a finger 20 which lies mainly between yoke part 15 and driving roller 6. Said finger 20 is formed by a metal rod which is rotatable at the top in body 18 and which is provided at the bottom with a guide strip which enters a groove 21 in driving roller 6.

Consequently driving roller 6 also forms a driven pattern roller which causes the reciprocating displacement of guide member 17 over guideway 14, 15. Groove 21 is an endless groove in the shape of a screw thread which runs to and fro over the driving roller 6. Where the direction changes, that is in the return points which lie respectively next to each end of driving roller 6, the path of groove 21 is of course radiused to let the direction change of finger 20 lying inside groove 21 occur without trouble. Due to driving roller 6 being made from synthetic material, the friction of finger 20 inside groove 21 is relatively light and no oil lubrication is required. Such oil lubrication would however be impossible as the driving roller 6 engages the yarn 4 which is wound on core 3 with the result that said yarn 4 would be soiled by lubricating.

The pattern roller-forming driving roller 6 is driven by a motor 22 which is mounted on the back side of wall 1 and the axis 23 of which goes through said wall 1. On front side of wall 1, said axis 23 bears a pulley 24 over which runs a belt 25. Said belt 25 also runs inside a groove 26 which is provided in that end nearest wall 1 of driving roller 6, right next to said groove 21. Driving roller 6 is driven at high speed.

Yarn 4 to be spooled is led along the top side over a thread-brake 27 which is mounted on the front side of wall 1, to the guide member 17. The yarn runs through the yarn guide and through a portion of a groove in driving roller 6 towards core 3. As it is particularly clear from FIG. 1, the yarn 4 engages over a substantial length the driving roller 6. As not only finger 20 but also the end of thread guide 19 of guide member 17 follows the groove 21, the yarn will try also to enter groove 21. As the groove depth is actually relatively small and side thrust is taken over by thread guide 19, the yarn 4 undergoes but a light friction inside groove 21.

Said entering of yarn 4 inside groove 21 has also the great advantage that there is a guiding of the thread up to the moment where the yarn reaches core 3. This does away with the requirement of bringing the end of thread guide 19 as close as possible to the contact line between core 3 or the already-wound yarn 4 thereon and the driving roller 6, which is necessary in other spooling machines when a good spool shape is to be obtained. In the above-described spooling machine, the thread guide 19 may consequently be of light and compact structure, which is in turn of importance to allow high spooling speeds.

Figure 3:
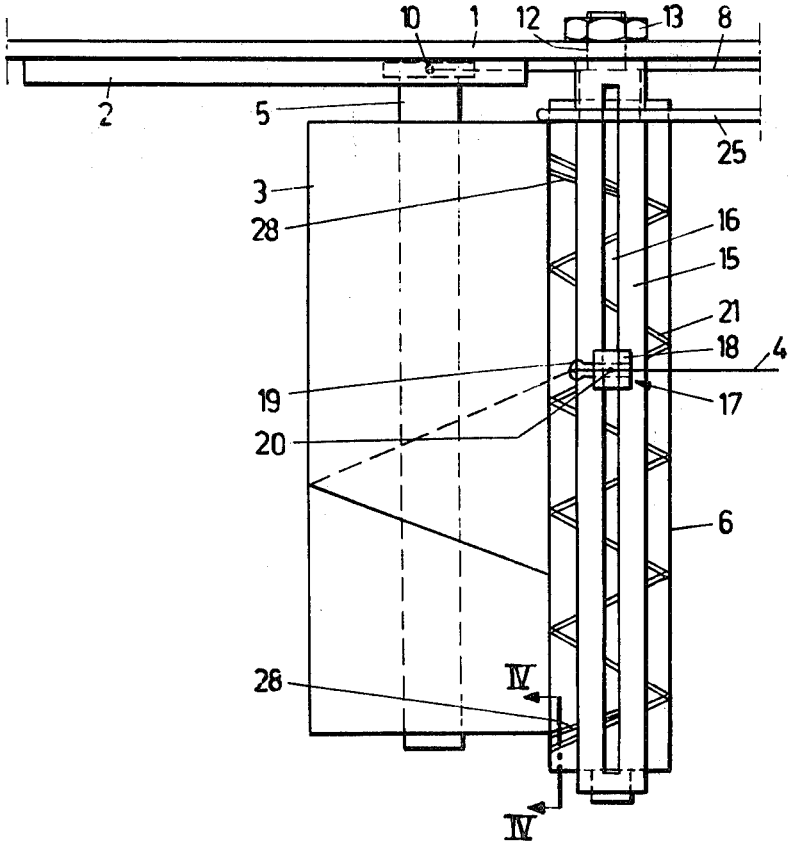
FIG. 3 is a top view of that machine portion shown in FIG. 2, drawn on the same scale as FIG. 2.

The above-described spooling machine may further be improved by providing driving roller 6 with additional grooves 28 which are used exclusively to guide the thread and thus not to guide finger 20. As it is particularly clear from FIG. 3, the end of thread guide 19 lies some distance away from the center of finger 20, in such a way that said end may lie not exactly above groove 21 but somewhat next thereto. The displacement of the end of thread guide 19 will actually let said end lie also above groove 21 when the thread guide moves in one direction over yoke 14, 15 but when moving in the opposite direction, the spacing of said thread guide end from groove 21 will be all the larger.

Now to avoid due to the moving of the end of thread guide 19 and consequently of the thread-guiding portion proper thereof next to groove 21, that yarn 4 leaves said groove 21, it is possible to widen the thread guide 19 or to provide an additional groove 28 in roller 6, said additional groove being out of phase relative to groove 21 and actually leading somewhat same.

Figure 2:
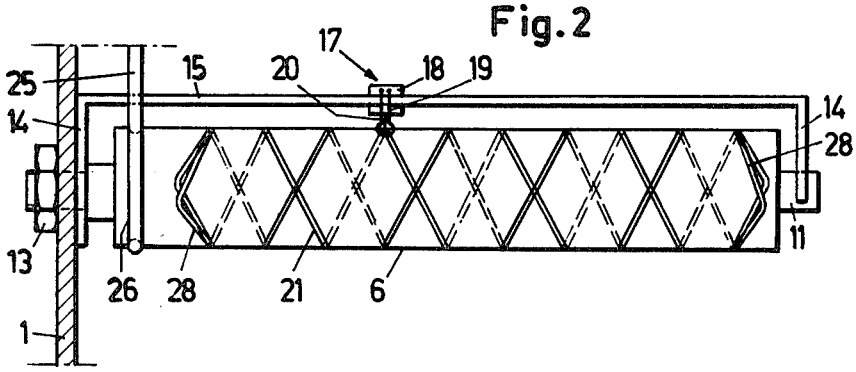
FIG. 2 is a cross-section along line II—II in FIG. 1, but drawn on a larger scale.
Figure 4:
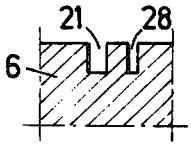
FIG. 4 is a cross-section along line IV—IV in FIG. 3.

In the simplest embodiment, it might be sufficient to provide such a groove 28 only next to the reversing points of groove 21 where said groove thus changes direction. Such an embodiment has been shown in FIGS. 2 to 4. Both grooves 28 next to both reversing points of groove 21 merge with the ends thereof with groove 21 on either side of the reversing point proper. The path of said additional grooves is such that the guiding portion proper, namely the above-mentioned end of thread guide 19 lies adjacent the reversing points of groove 21, above said additional groove when finger 20 enters groove 21. Said end will then reach the reversing point thereof, that is the reversing point of additional groove 28, at the moment where finger 20 reaches the reversing point of groove 21. The additional groove 28 will cross groove 21 some distance away from the actual reversing point of said groove 21. To prevent the finger entering the additional groove 28 at said crossing, said groove 28 has a cross-section different from the cross-section of groove 21. The additional grooves 28 then also guide with a small thread guide, the yarn 4 along a groove to the core 3.

Figure 5:
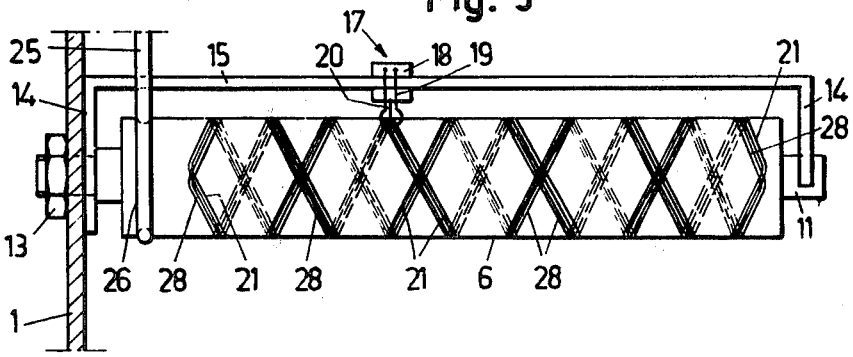
FIG. 5 is a cross-section similar to FIG. 2 but pertaining to another embodiment of the spooling machine according to the invention.

In a variation of the above embodiment, the additional groove 28 instead of being provided only next to the reversing points of groove 21, runs over the whole length out of phase relative to groove 21. Said additional groove is then also a groove running to and fro in the shape of a screw thread the path of which is so designed that the end of thread guide 19 always lies precisely opposite when finger 20 enters groove 21. Said variation is shown in FIG. 5.

Due to the driving roller 6 also forming the pattern roller, the construction of the above-described machine is quite simple and cheap. Due to the guide member 17 guiding the yarn through a groove to the core 3, an accurate spooling is obtained. Said accuracy is further improved when the yarn 4 is guided by an additional groove 28 at least adjacent to the reversing points of groove 21 where said yarn changes direction.

It must be understood that the invention is in no way limited to the above embodiments and that many changes can be brought therein without departing from the scope of the invention as defined by the appended claims.

For instance, the pattern roller-forming driving roller should not necessarily run in parallel relationship with the axis on which the core is rotatably mounted. This is for example not the case when a cone-shaped yarn spool is to be formed.

I claim:

1. In a spooling machine for winding thread-like material, particularly yarns, on a material bearing core which comprises a frame, a bearing axis mounted thereon for the core on which the material has to be spooled, a driving roller mounted on said frame for driving the material-bearing core, means to drive the driving roller, means for effecting the engagement between the material-bearing core and said driving roller to cause driving of the material-bearing core, and a displacement device to reciprocate the material to be spooled during the spooling thereof along the lengthwise axis of the bearing axis, said displacement device comprising a pattern roller which is formed by the above mentioned driving roller, said pattern roller being provided with an endless groove that runs alternately as a screw-thread over said roller with reversing points adjacent each end of said roller, a guide member for the thread-like material, said guide member having a thread guiding portion and a driven part a portion of which enters the groove in the driving pattern roller along which the guide-member is reciprocable, wherein the improvement comprises a second separate groove through which the thread-like material passes, said second groove being positioned at least adjacent the reversing points of said endless groove.

2. A spooling machine as in claim 1, wherein said second groove extends along the whole length of said endless groove and crossing same next to the reversing points.

3. A spooling machine as in claim 1 or 2, wherein the path of said second groove is so designed that by the reciprocating movement of the guide-member, the thread-guiding portion of said guide member moves precisely over said second groove when said driven part moves in said endless groove.

4. A spooling machine as in claim 1, wherein said second groove is staggered relative to said first groove.

5. A spooling machine as in claim 2, wherein said second groove is out of phase with respect to said first groove.

* * * * *